United States Patent [19]

Beversdorf

[11] 3,942,764

[45] Mar. 9, 1976

[54] PROTECTIVE FENCING

[76] Inventor: Elmer J. Beversdorf, 1551 Infantry Ave., Detroit, Mich. 48209

[22] Filed: May 22, 1972

[21] Appl. No.: 255,203

[52] U.S. Cl. ..... 256/24; 49/50; 49/55; 52/667; 52/669; 256/21

[51] Int. Cl.[2] ..... E06B 3/68; E04H 17/16

[58] Field of Search ..... 52/581, 626, 656, 667, 52/669, 660; 49/50, 52, 54, 38, 55, 56; 256/21, 47, 65, 24; 109/11, 15; 160/130

[56] References Cited

UNITED STATES PATENTS

| | | | |
|---|---|---|---|
| 235,518 | 12/1880 | Delany | 256/47 |
| 1,228,062 | 5/1917 | Scofield | 256/21 |
| 1,316,893 | 9/1919 | Hohaus | 256/24 |
| 1,629,541 | 5/1927 | Scholer | 49/56 |
| 2,299,143 | 10/1942 | Hellwig | 256/21 |

FOREIGN PATENTS OR APPLICATIONS

| | | | |
|---|---|---|---|
| 8,550 | 3/1897 | United Kingdom | 52/660 |
| 237,099 | 7/1925 | United Kingdom | 256/47 |

*Primary Examiner*—Dave W. Arola
*Assistant Examiner*—Conrad L. Berman

[57] ABSTRACT

A metallic structural fencing having inter-engaged horizontal and vertical members is disclosed. The horizontal members are lanced to provide laterally projecting web sections adapted to receive and engage the vertical members which are secured to the top and bottom horizontal members. The horizontal members are secured to vertical framing members at their ends.

5 Claims, 7 Drawing Figures

PROTECTIVE FENCING

The invention comprises a plurality of vertically spaced apart, horizontally extending parallel metallic bar members, each of which is provided with a plurality of lanced web sections projecting laterally from one side of the member a distance sufficient to provide a vertical space within which metallic vertical bar members can be positioned. The lanced webs are formed from a medial portion of the horizontal member, or alternatively can be formed at the upper or lower edges of the member. The lanced webs are aligned vertically in rows so that the vertical members can be disposed within the webs of each of the horizontal members. The ends of the horizontal members are secured to vertical framing members by suitable fasteners such as rivets, bolts and nuts, etc. The upper and lower ends of the vertical members are formed with return bent portions over the edges of the top and bottom horizontal members, securing the vertical members thereto. In effect, the fencing of this invention provides a protective grille work for windows, openings in wall structures, land, and other property. Tie bars or brackets connecting adjacent units of the protective fencing are secured to the vertical framing members of such adjacent units, preferably by rivets, allowing each unit to assume its own horizontal level.

It is an object of the invention to provide a grille-type protective fencing having a plurality of vertically spaced apart horizontal members, each provided with lanced webs extending laterally outwardly from the horizontal members and in register for reception therewithin of vertical bar members. Another object is to provide vertical bar members which are formed with return bends over the top and bottom horizontal members to engage the same. A further object is to provide vertical framing members at the lateral sides of the fencing for securement of the horizontal members thereto, to form a fencing unit. Still another object is to provide a modification of the horizontal members wherein the lanced webs can be disposed at upper or lower edges of the horizontal members. Yet another object is to provide protective fencing of relatively inexpensive construction, readily formed and assembled.

Various further and more specific objects, features and advantages of the invention will appear from the description given below, taken in connection with the accompanying drawings, illustrating by way of example a preferred form of the invention. Reference is here made to the drawing annexed hereto and forming an integral part of this specification, in which FIG. 1 is a perspective view of a preferred form of protective fencing embodying the invention, secured over a window in a building.

Figure 1:
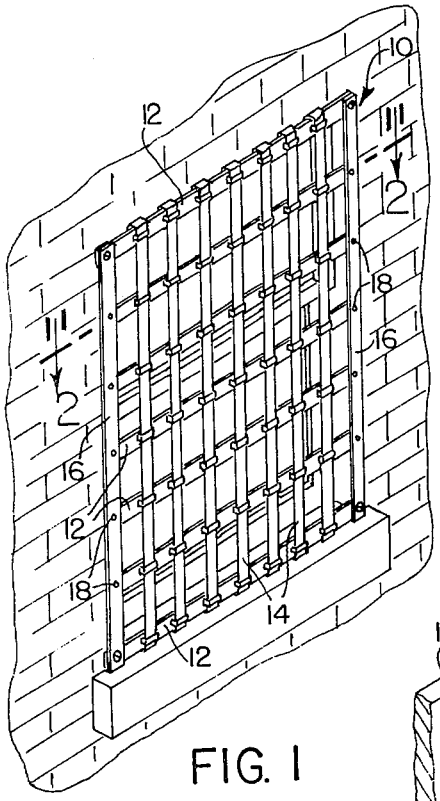
Figure 2:
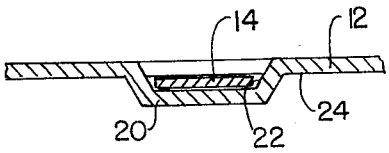
FIG. 2 is a fragmentary horizontal sectional view taken substantially on the line 2—2 of FIG. 1.

As illustrated in the several views of the drawing, the protective fencing 10 comprises a plurality of horizontal bar members 12, vertical bar members 14, a pair of lateral vertical framing members 16, and fasteners 18 securing the ends of the horizontal members 12 to the vertical lateral framing members 16.

The horizontal bar members 12 are spaced vertically apart from each other, in equal or unequal increments as desired or required, and are each provided with laterally outwardly extending horizontally spaced apart lanced webs 20 to form vertical spacings or openings 22 between the lateral surface 24 of the horizontal bar member 12 through which the vertical bar member 14 will pass. The lanced web 20 has a width sufficient to allow the vertical bar member 14 to pass into the space 22 with relative ease and with only a very small side "play." The height of the web 20 should be fairly substantial but preferably not more than one-half the height of the horizontal bar member, in order to provide substantial strength to the web and avoid undue weakening of the horizontal bar member at the lanced web section.

Figure 3:
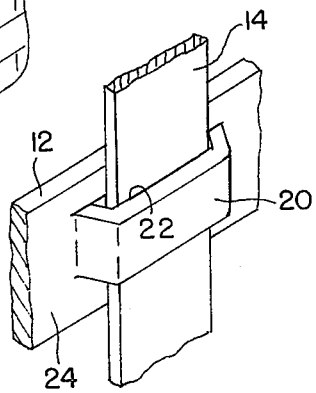
FIG. 3 is a fragmentary perspective view of the lanced web and vertical member engaged therewithin, in accordance with the embodiment illustrated in FIGS. 1 and 2.
Figure 4:
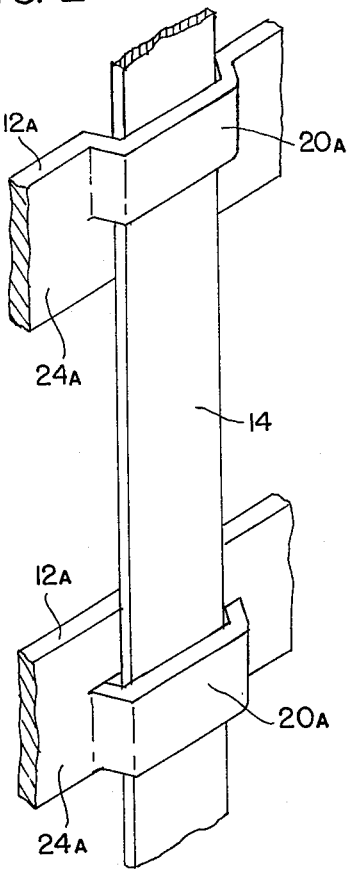
FIG. 4 is a perspective view similar to that illustrated in FIG. 3, showing a modified form of the horizontal member with its lanced web.
Figure 5:
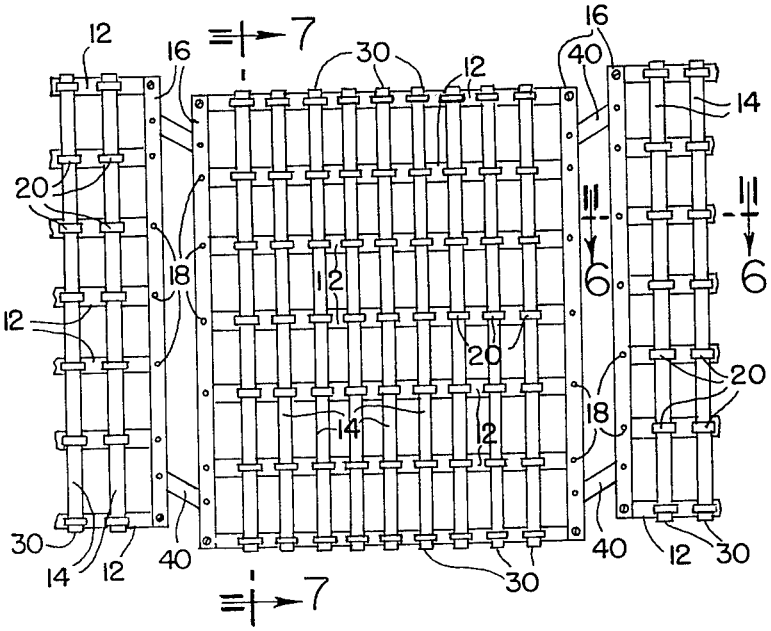
FIG. 5 is a front elevational view of connected adjacent fencing units, in which the central unit is disposed at a horizontal level below that of connected adjacent units.

A modified form of the lanced web is illustrated in FIG. 4 wherein the web section **20*a* is disposed adjacent the upper and lower edges of horizontal bar members 12*a*, rather than intermediate the height of the bar member 12 as in FIG. 3. The spacing of the web 20*a* from the lateral surface 24*a* of the bar member is the same as that for the lanced web 20. As illustrated, the modified lanced web 20*a* can be disposed in the upper or lower half portions of the horizontal bar members 12*a***.

Figure 6:
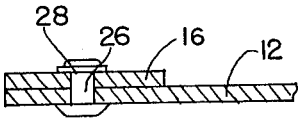
FIG. 6 is a fragmentary horizontal sectional view taken substantially on the line 6—6 of FIG. 5.

The fasteners 18 comprise conventional bolts and nuts to secure the lateral framing members 16 to the ends of the horizontal bar members 12, or headed rivets 26 (FIG. 6) with a washer 28 under the peened end of the rivet.

Figure 7:
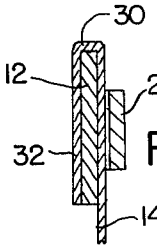
FIG. 7 is a fragmentary vertical sectional view, taken substantially on the line 7—7 of FIG. 5.

The vertical bar members 14 engage the top and bottom horizontal members 12 by bending their upper and lower end portions 30,30 snugly and firmly about the horizontal members 12, as illustrated particularly in FIG. 7. The end portions 30,30 of the vertical members are formed with returned vertical portions 32 to engage the top and bottom horizontal members 12. The horizontal bar members 12 (or **12*a*, as the case may be) are arranged in vertical spaced apart relationship with their lanced webs 20 in alignment one above the other so that the vertical bar members 14 can be inserted within the spacing 22 of each web 20 to engage each of the horizontal bar members. After securing the ends of the horizontal members 12 to the vertical framing members 16 by the fasteners 18, the end portions 30,30 of the vertical members 14 are bent over the top and bottom horizontal bar members 12, forming a fencing unit 10**.

The metallic fencing units 10 can be connected together by tie bars or brackets 40 which are secured to adjacent vertical framing members 16 by rivets and washers 26, 28 respectively, allowing each fencing unit to assume a horizontal level the same as or different from the level of the next adjacent unit or units, according to the application in which the fencing units are disposed.

Although the horizontal members 12 (or 12*a*) can be secured at their ends to the vertical framing members 16 by the fasteners 18, it will of course be understood that the members 12 can be affixed to the framing members 16 by welding or other suitable means.

Although particular embodiments of the invention have been disclosed herein for purposes of explanation, further modifications or variations thereof, after study of this specification, will or may become apparent to those skilled in the art to which the invention pertains. Reference should be had to the appended claims in determining the scope of the invention.

I claim:

1. In grille-type protective fencing, the improvements comprising in combination a plurality of vertically spaced apart, horizontally extending, substantially parallel planar bar members, each of said horizontal planar bar members having a plurality of substantially planar lanced webs extending laterally from one side only of the body and plane of said member in horizontally spaced apart relationship and in vertical alignment with the lanced webs of the remaining horizontal planar bar members, each said lanced web being integrally formed and continuous from its conjunction at each end thereof with the body of said horizontal planar bar member, a plurality of intermediate vertical planar bar members engaged with said horizontal planar bar members within said planar lanced webs, the bodies of said horizontal planar bar members lying substantially in a first plane, said intermediate vertical planar bar members lying substantially in a second plane substantially parallel to and ajdacent said first plane, and said horizontally extending planar lanced webs lying substantially in a third plane substantially parallel to and adjacent said second plane, each said lanced web forming a vertical space for reception of each said vertical bar member therewithin, said space being sufficient to receive and pass said vertical bar member with very slight "play" between each said vertical bar member and each said horizontal bar member, each of said intermediate vertical planar bar members having their end portions engaging and embracing the top and bottom horizontal planar bar members, and lateral vertical framing members fixedly secured to the ends of said horizontal planar bar members at each lateral side of said fencing to form a substantially rectilinear fencing unit.

2. The fencing structure defined in claim 1, wherein said lanced webs extend from the medial portion of each said horizontal bar member.

3. The fencing structure defined in claim 1, wherein said lanced webs extend from an edge portion of each said horizontal bar member.

4. The fencing structure defined in claim 1, wherein said lanced webs are spaced horizontally apart from each other in equal increments.

5. The fencing structure defined in claim 1, wherein the vertical height of said lanced webs is equal to substantially one-half the height dimension of each said horizontal bar member.

* * * * *